US005551691A

United States Patent [19]

Harada et al.

[11] Patent Number: 5,551,691

[45] Date of Patent: Sep. 3, 1996

[54] GOLF CLUB SHAFT

[75] Inventors: Takashi Harada, Misato; Akira Suzawa, Koshigaya; Yoshihiro Motoki, Misato, all of Japan

[73] Assignee: Somar Corporation, Japan

[21] Appl. No.: 556,073

[22] Filed: Nov. 2, 1995

[30] Foreign Application Priority Data

Jun. 7, 1995 [JP] Japan ..... 7-194279

[51] Int. Cl.[6] ..... A63B 53/10

[52] U.S. Cl. ..... 473/323; 473/318

[58] Field of Search ..... 273/80 B, 80 C, 273/80 A, 80.9, 80.6, 80.5, 80 R, DIG. 7, DIG. 23

[56] References Cited

U.S. PATENT DOCUMENTS

| | | | |
|---|---|---|---|
| 1,980,031 | 11/1934 | Bradlig | 273/80.6 |
| 4,288,075 | 9/1981 | Kaugars et al. | 273/80 B |
| 5,018,735 | 5/1991 | Meredith et al. | 273/80 B |
| 5,251,896 | 10/1993 | Gerlach | 273/80 B |
| 5,265,872 | 11/1993 | Tennent et al. | 273/80.6 |
| 5,297,791 | 3/1994 | Negishi | 273/80 B |

FOREIGN PATENT DOCUMENTS

| | | | |
|---|---|---|---|
| 2667794 | 4/1992 | France | 273/80 B |
| 447319 | 5/1936 | United Kingdom | 273/80 B |
| 482164 | 3/1938 | United Kingdom | 273/80 B |

*Primary Examiner*—Mark S. Graham
*Attorney, Agent, or Firm*—Lorusso & Loud

[57] ABSTRACT

A hollow, fiber-reinforced plastic golf club shaft is disclosed which is tapered from the grip to the hosel and which is provided with an enlarged portion in an intermediate portion so that the flexural rigidity of the shaft is abruptly changed at the enlarged portion.

8 Claims, 4 Drawing Sheets

GOLF CLUB SHAFT

BACKGROUND OF THE INVENTION

This invention relates to a hollow golf club shaft formed of a fiber-reinforced plastic (FRP).

Golf club shafts formed of FRP are now increasingly used for both iron and wood clubs. For the production of FRP shafts, the filament winding method and the sheet winding method are generally used. In the former method, a fiber tow impregnated with a matrix resin is wound around a mandrel. In the latter method, a prepreg sheet composed of uniaxially oriented fibers impregnated with a matrix resin is wound around a mandrel. The filament winding method has a merit that it is possible to continuously or intermittently change the winding angle relative to the centerline axis of the shaft so as to control the kick point and flexural rigidity of the shaft. Since, however, the winding angle cannot be abruptly changed, it is impossible to impart great changes in flexural rigidity along the length of the shaft by the filament winding method.

SUMMARY OF THE INVENTION

It is an object of the present invention to provide a golf club shaft which has flexural rigidity characteristics such that the shaft flexes at a predetermined point and which permits stable swings with good impact feeling so that the shot direction is stabilized and the flight distance is increased.

In accordance with the present invention there is provided a hollow golf club shaft having a tip end and a grip end and formed of a fiber-reinforced plastic. The distance between the tip end and the grip end, namely the length of the shaft, is generally 850–1,200 mm. The golf club shaft comprises, in adjacent order from the tip end to the grip end, a hosel section, a first intermediate section, a protruded section, a second intermediate section, and a grip section. The first intermediate section has varying outer diameter increasing from its junction J1 with the hosel section to its junction J2 with the protruded section, while the second intermediate section has varying outer diameter increasing from its junction J3 with the protruded section to its junction J4 with the grip section. The present invention is characterized in that the protruded section has varying outer diameter which increases from the junction J2 to an apex point located between the junction J2 and the junction J3 and which decreases from the apex point to the junction J3; that the outer diameter of the shaft at the junction J3 is greater than that at the junction J2; that the junction J3 is located at a position spaced apart from the tip end a distance equal to 35–80% of the length from the tip end to the grip end; and that the distance between the junction J2 and the junction J3 is in the range of 50–400 mm.

BRIEF DESCRIPTION OF THE DRAWINGS

Other objects, features and advantages of the invention will become apparent from the detailed description of the preferred embodiments which follow, when considered in light of the accompanying drawings, in which.

DETAILED DESCRIPTION OF THE PREFERRED EMBODIMENTS OF THE INVENTION

Figure 1:
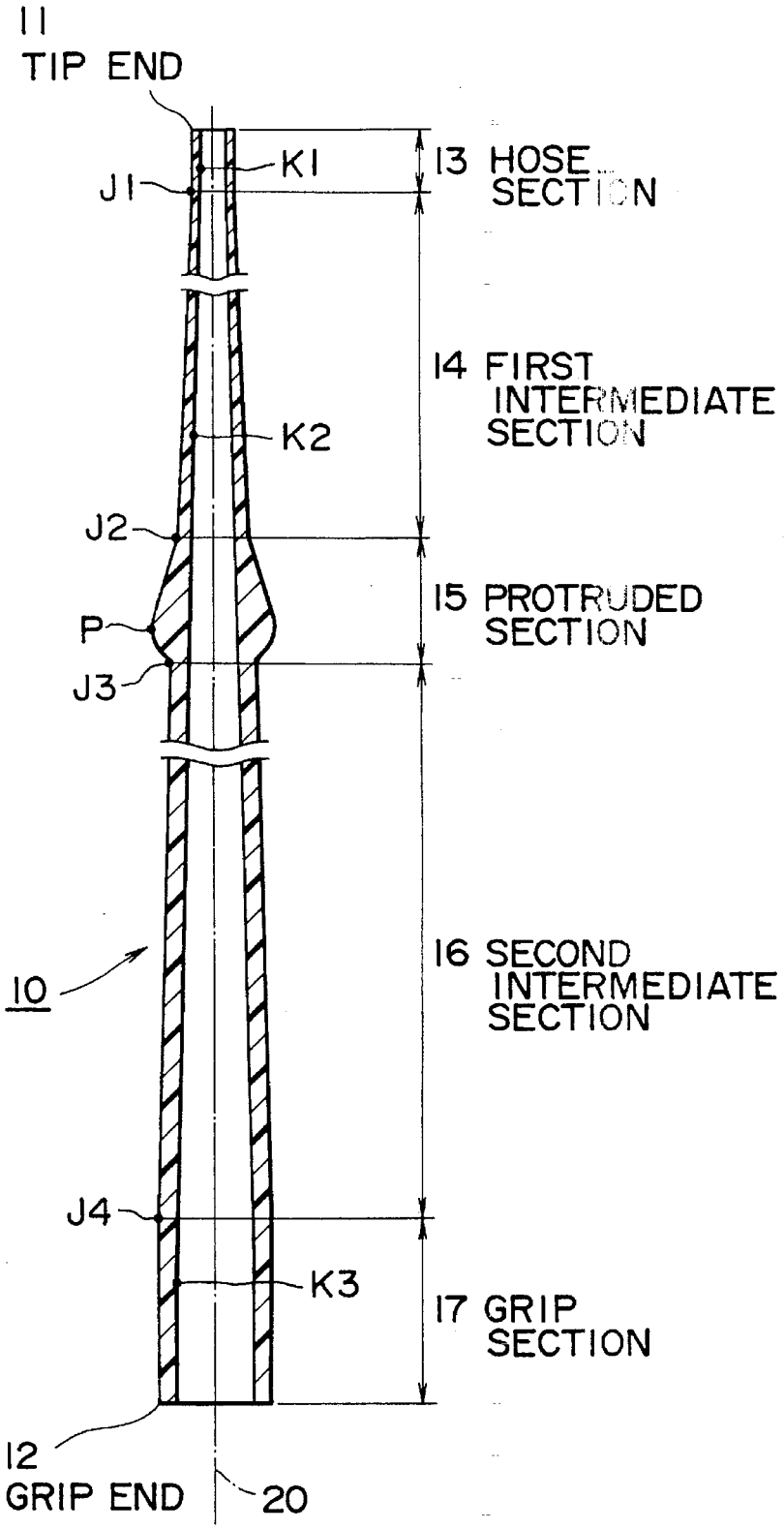
FIG. 1 is a sectional view diagrammatically illustrating one embodiment of a golf club shaft according to the present invention.

Referring now to FIG. 1, generally designated by the reference numeral 10 is a hollow golf club shaft according to the present invention formed about a centerline axis 20. The shaft 10 is made of a fiber-reinforced plastic and is preferably formed by the filament winding method. The fiber may be, for example, carbon fiber, glass fiber, aromatic polyamide fiber, titanium fiber or ceramic fiber. The plastic is a thermosetting resin generally used for the formation of various prepregs such as an epoxy resin.

The golf club shaft 10 has a tip end 11 and a grip end 12 generally spaced apart from each other a distance of about 850–1,200 mm. A hosel section 13 adapted for connection with an iron club head or a wood club head extends from the tip end 11 to a junction J1 thereof with an adjacent first intermediate section 14. The first intermediate section 14 thus extends from the junction J1 to a junction J2 thereof with an adjacent protruded section 15 which in turn extends from the junction J2 to a junction J3 at which the protruded section 15 abuts an adjacent second intermediate section 16. The second intermediate section 16 extends from the junction J3 to its junction J4 with an adjacent a grip section 17. The grip section terminates at the grip end 12 and is adapted to receive a hand grip surrounding at least a portion of an outer surface of the grip section 17. While these sections 13 through 17 represent slightly different structures, it will be understood that they are all part of the unitary shaft and are not separate components which must be joined.

The hosel section 13 has generally a constant outer diameter but may be tapered in the direction from the tip end 11 to the junction J1 or vice versa. The length, i.e. axial distance between the tip end 11 to the junction J1, and the outer diameter of the hosel section 13 are generally up to 300 mm and 6–10 mm, respectively.

The grip section 17 may have a constant outer diameter or may be tapered in the direction from the grip end 12 to the junction J4 or vice versa The taper is generally 0–1.5%, preferably 0–1%. The length, i.e. axial distance between the grip end 12 to the junction J4, and the outer diameter of the grip section 17 are generally up to 400 mm and 13–17 mm, respectively.

In the present specification and appended claims, the term "taper" of a golf club shaft is defined as a percentage of a difference in diameter between two points based on the axial distance therebetween. For example, in the case of the golf club shaft shown in FIG. 2, the taper TPI of the outer surface of the shaft between the point P and the point J3 is calculated by the following equation:

$$TPI=D/W\times 100\ (\%)$$

The first intermediate section 14 has varying outer diameter increasing from the junction J1 to the junction J2. Similarly, the second intermediate section 16 has varying outer diameter increasing from the junction J3 to the junction J4.

The protruded section 15 has varying outer diameter which increases from the junction J2 to an apex P located between the junctions J2 and J3 and which decreases from the apex P to the junction J3. The outer diameter of the shaft at the junction J3 is greater than that at the junction J2 so that the shaft 10 is radially outwardly expanded in the protruded section 15.

The junction J3 is located at a position spaced apart from the tip end an axial distance equal to 35–80%, preferably 40–75%, of the axial length from the tip end to the grip end. The axial distance L between the junction J2 and the junction J3 is in the range of 50–400 mm, preferably 80–350 mm. The outer diameter of the shaft at the apex P is preferably greater by 0.3–3 mm, more preferably 0.3–2.8 mm, than that at the junction J3. It is also preferred that the axial distance between the junction J2 and the apex P be greater than that between the apex P and the junction J3.

The preferred ranges of the tapers of the outside surfaces of respective sections are as follows:

| | Preferred | More Preferred |
|---|---|---|
| between the junctions J1 and J2: | 0.1–1.5% | 0.3–1% |
| between the junction J2 and apex point: | 0.1–6.5% | 0.5–4% |
| between the apex point and junction J3: | 0.1–6.5% | 1–5% |
| between the junctions J3 and J4: | 0.1–1.5% | 0.4–1% |

The taper of the shaft 10 in the first intermediate section is preferably smaller than that between the junction J2 and the apex P.

The golf club shaft 10 preferably has such an inside surface construction that the inside diameter of the shaft increases from a first point K1 located between the tip end 11 and the junction J1 to a second point K2 located between the junction J1 and the junction J2 and from the second point K2 to a third point K3 located between the junction J4 and the grip end 12.

The preferred ranges of the tapers of the inside surfaces of respective sections are as follows:

| | Preferred | More Preferred |
|---|---|---|
| between the tip end and first point K1: | 0–4% | 0–3% |
| between the points K1 and K2: | 0.2–4% | 0.4–2% |
| between the points K2 and K3: | 0.4–2% | 0.5–1.5% |
| between the point K3 and grip end: | 0–2% | 0–1.5% |

Figure 4:
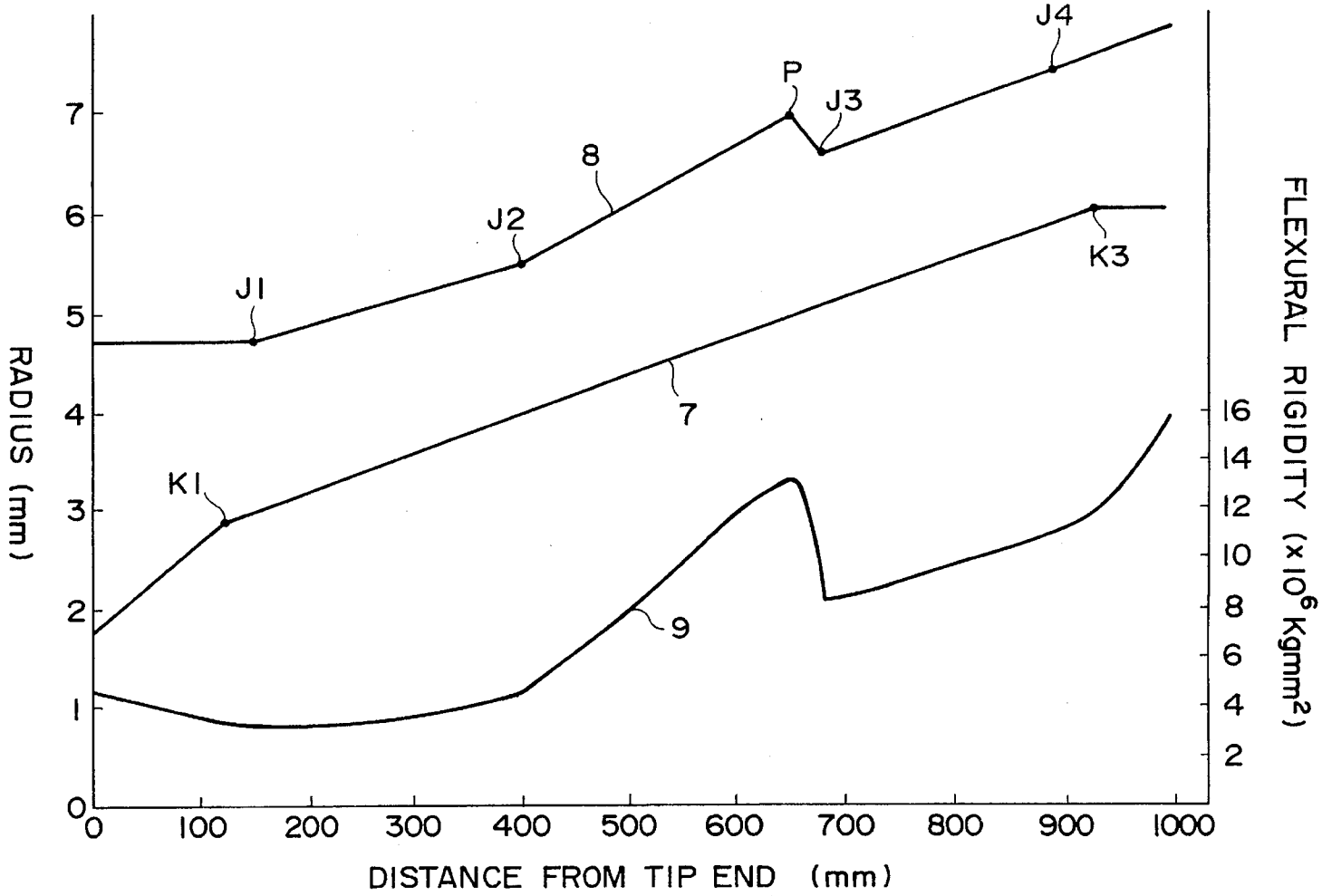
FIG. 4 is an illustration similar to FIG. 2 showing changes of (a) the outside radius, (b) inside radius and (c) flexural rigidity of a shaft for an iron club according to the present invention (Example 4) by the lengthwise position thereto.

The taper of the inside surface of the shaft 10 in respective sections may be the same. For example, as shown in FIG. 4, the taper between the points K1 and K2 may be the same as that between the points K2 and K3 so that K2 is not shown in FIG. 4.

The golf club shaft according to the present invention may be prepared as follows.

A roving or tow of reinforcing fibers impregnated with a hardenable resin is wound at varying or constant winding angle by a filament winding method around. The fiber layer may be a single layer or two or more layers having different winding angle patterns. The wound layer is then hardened and the mandrel is removed to leave a shaft. The both ends of the shaft are cut to adjust the length thereof to a predetermined value and the outer surface of the shaft is ground to a predetermined diameter, thereby to obtain the ultimate shaft 10.

The following examples will further illustrate the present invention.

Example 1

Figure 2:
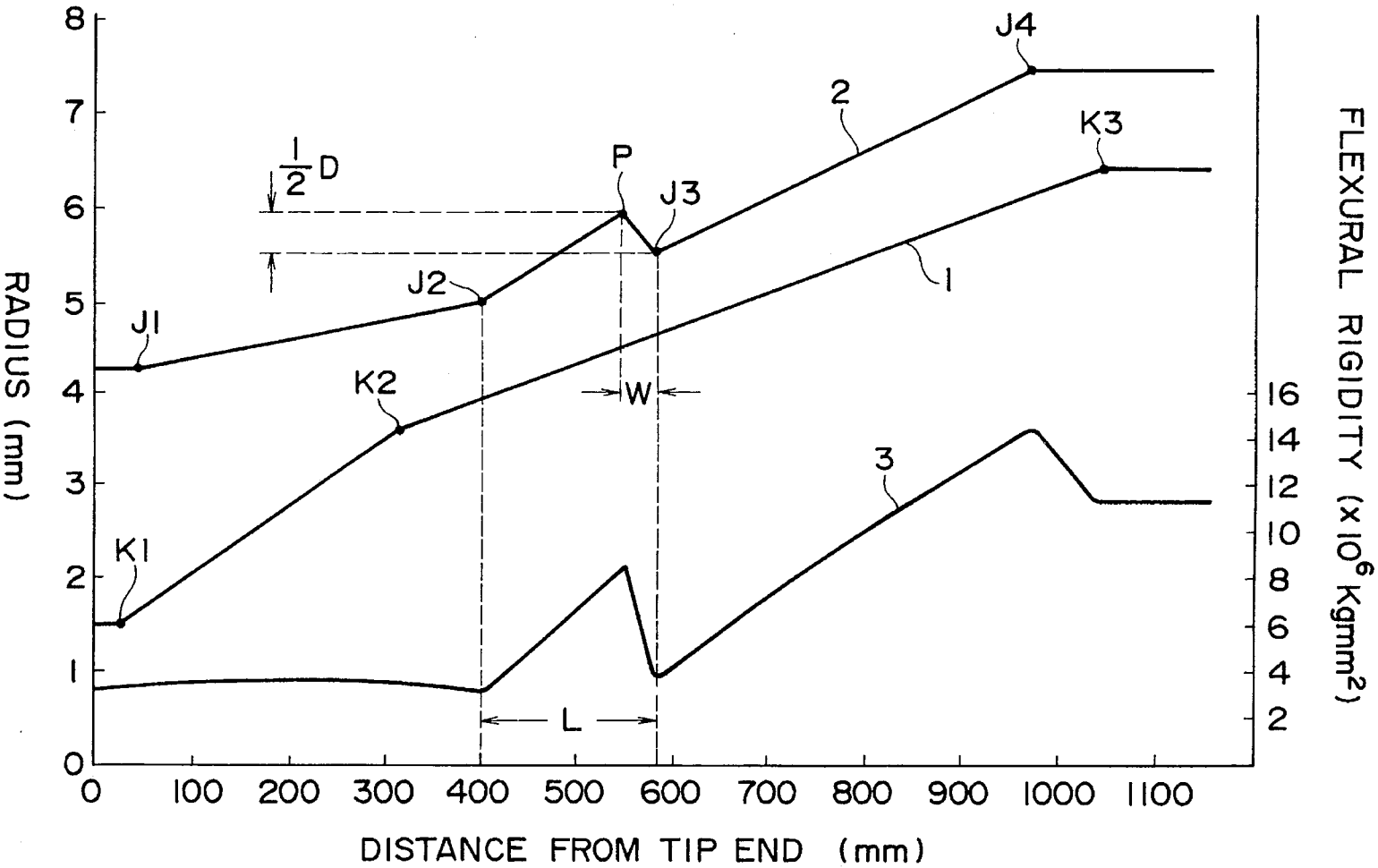
FIG. 2 illustrates changes of (a) the outside radius, (b) inside radius and (c) flexural rigidity of a golf club shaft of Example 1 by the lengthwise position thereof.

A tow of carbon fibers was impregnated with a hardenable epoxy resin composition and then wound around a stainless steel mandrel having a length of 1350 mm, diameters at the smaller diameter and larger diameter ends of 3.0 mm and 12.7 mm, respectively, and an outer surface diameter pattern as shown by a plot 1 in FIG. 2 at a winding angle of 22°–46° to form an inner layer. Another tow of carbon fibers was impregnated with the same hardenable epoxy resin composition as used in the formation of the inner layer and then wound around the inner layer at a winding angle of 12°–16° to obtain an outer layer. This was then heated at 130° C. for 2 hours to completely cure the outer layer. After being cooled to room temperature, the mandrel was removed. The resulting raw shaft was machined and sanded to form a golf club shaft having a length of 1145 mm, a tip end outside diameter of 8.5 mm, a grip end outside diameter of 14.6 mm, an inside diameter pattern as shown by the plot i in FIG. 2 and an outer diameter pattern as shown by the plot 2. The taper of the inside surface of the shaft at the section K2–K3, the taper of the outer surface of the shaft at each of the sections J1–J2, J2–P, P–J3, J3–J4, the difference D between the outside diameter at the apex P and the outside diameter at the junction J3, the location of the junction in terms of the percentage of the distance from the tip end to the junction J3 based on the total length of the shaft and the axial length L of the protruded section (J2–J3) are summarized in Table 1. The shaft was found to show the flexural rigidity pattern as shown by the plot 3 in FIG. 2.

In this example, junctions J1 through J4 are in the form of angular corners. These corners are generally further processed and rounded to provide a smooth contour.

Example 2

A raw shaft obtained in the same manner as described in Example 1 was machined and sanded to obtain a golf club shaft having the same length, tip end outside diameter, grip end outside diameter and inside diameter pattern as those in Example 1. The taper of the inside surface of the shaft at the section K2–K3, the taper of the outer surface of the shaft at each of the sections J1–J2, J2–P, P–J3, J3–J4, the difference D between the outside diameter at the apex P and the outside diameter at the junction J3, the location of the junction J3 in terms of the percentage of the distance from the tip end to the junction J3 based on the total length of the shaft and the axial length L of the protruded section (J2–J3) are summarized in Table 1.

Example 3

A raw shaft obtained in the same manner as described in Example 1 was machined and sanded to obtain a golf club shaft having the same length, tip end outside diameter, grip end outside diameter and inside diameter pattern as those in Example 1. The taper of the inside surface of the shaft at the section K2–K3, the taper of the outer surface of the shaft at each of the sections J1–J2, J2–F, P–J3, J3–J4, the difference D between the outside diameter at the apex P and the outside diameter at the junction J3, the location of the junction J3 in terms of the percentage of the distance from the tip end to the junction J3 based on the total length of the shaft and the axial length L of the protruded section (J2–J3) are summarized in Table 1.

Comparative Example 1

Figure 3:
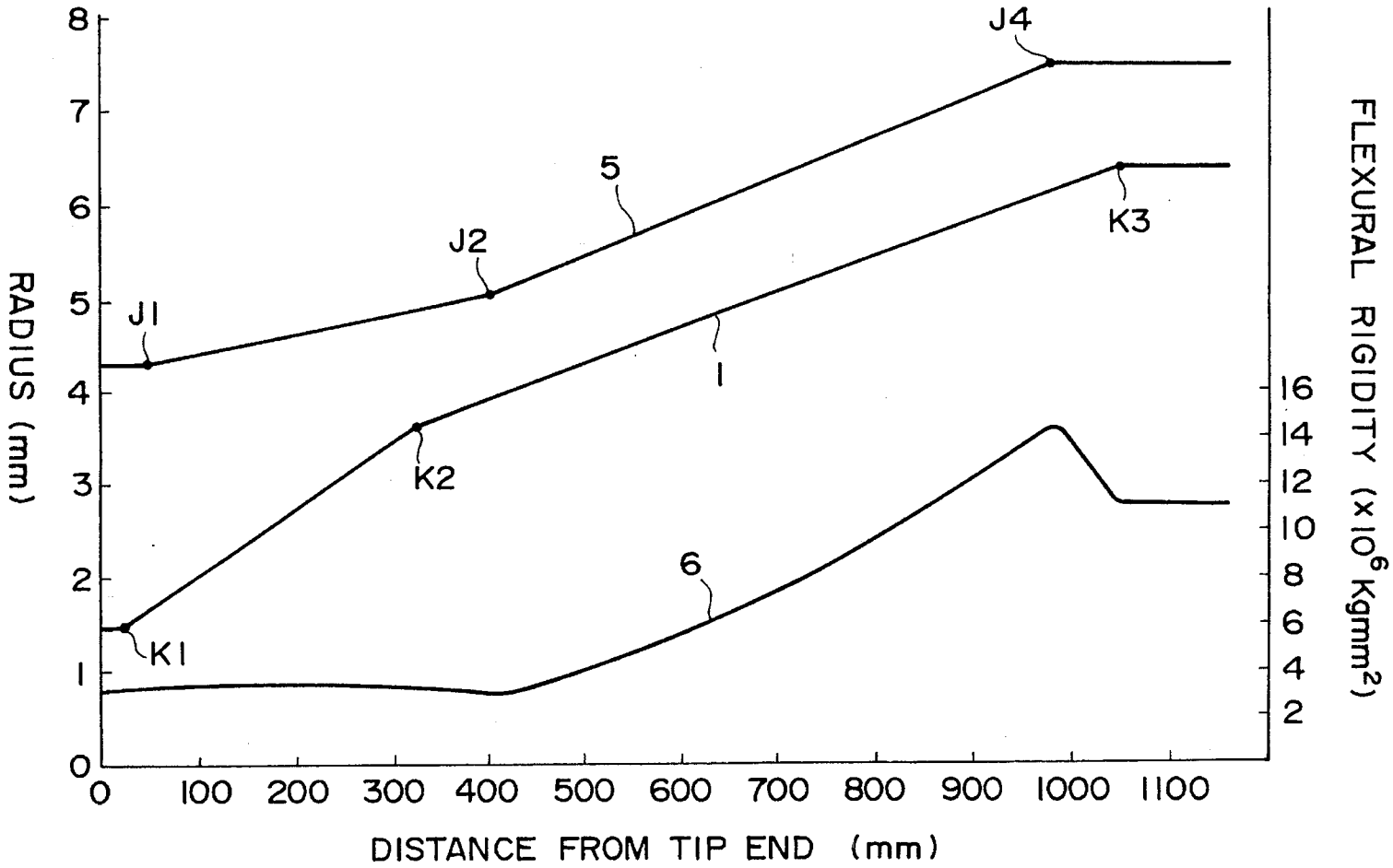
FIG. 3 PRIOR ART
FIG. 3 is an illustration similar to FIG. 2 showing changes of (a) the outside radius, (b) inside radius and (c) flexural rigidity of a conventional golf club shaft (Comparative Example 1) by the lengthwise position thereof.

A raw shaft obtained in the same manner as described in Example 1 was machined and sanded to obtain a golf club shaft having the same length, tip end outside diameter, grip end outside diameter and inside diameter pattern as those in Example 1. But the shaft had an outer diameter pattern as shown by the plot 5 in FIG. 3. The taper of the inside surface of the shaft at the section K2–K3 and the taper of the outer surface of the shaft at each of the sections J1–J2 and J2–J4 are summarized in Table 1. The shaft was found to show the flexural rigidity pattern as shown by the plot 6 in FIG. 3.

TABLE 1

| Example No. | 1 | 2 | 3 | Comp. 1 |
|---|---|---|---|---|
| Taper (%) | | | | |
| K2-K3 | 0.75 | 0.75 | 0.75 | 0.75 |
| J1-J2 | 0.43 | 0.43 | 0.43 | 0.43 |
| J2-P | 1.27 | 1.00 | 1.10 | 0.83 |
| P-J3 | 3.00 | 2.00 | 2.50 | 0.83 |
| J3-J4 | 0.97 | 0.96 | 1.00 | 0.83 |
| Difference D (mm) | 0.90 | 0.74 | 1.00 | — |
| Length L (mm) | 180 | 340 | 240 | — |
| Location J3 (%) | 51 | 65 | 56 | — |

Example 4

A tow of carbon fibers was impregnated with a hardenable epoxy resin composition and then wound around a stainless steel mandrel having a length of 1350 mm, diameters at the smaller diameter and larger diameter ends of 3.0 mm and 12 mm, respectively, and an outer surface diameter pattern as shown by a plot 7 in FIG. 4 at a winding angle of 33°–54° to form an inner layer. Another tow of carbon fibers was impregnated with the same hardenable epoxy resin composition as used in the formation of the inner layer and then wound around the inner layer at a winding angle of 9.5°–17° to obtain an outer layer. This was then heated at 130° C. for 2 hours to completely cure the outer layer. After being cooled to room temperature, the mandrel was removed. The resulting raw shaft was machined and sanded to form a golf club shaft having a length of 991 mm, a tip end outside diameter of 9.4 mm, a grip end outside diameter of 15.4 mm, an inside diameter pattern as shown by the plot 7 in FIG. 4 and an outer diameter pattern as shown by the plot 8 in FIG. 4. The taper of the inside surface of the shaft at the section K1–K3, the taper of the outer surface of the shaft at each of the sections J1–J2, J2–P, P–J3, J3–J4, the difference D between the outside diameter at the apex P and the outside diameter at the junction J3, the location of the junction J3 in terms of the percentage of the distance from the tip end to the junction J3 based on the total length of the shaft and the axial length L of the protruded section (J2–J3) are summarized in Table 2. The shaft was found to show the flexural rigidity pattern as shown by the plot 9 in FIG. 4.

TABLE 2

| Example No. | 4 |
|---|---|
| Taper (%) | |
| K1-K3 | 0.78 |
| J1-J2 | 0.60 |
| J2-P | 1.16 |
| P-J3 | 2.33 |
| J3-J4 | 0.69 |
| Difference D (mm) | 0.70 |

TABLE 2-continued

| Example No. | 4 |
|---|---|
| Length L (mm) | 250 |
| Location J3 (%) | 68.6 |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A hollow golf club shaft having a tip end and a grip end and formed of a fiber-reinforced plastic, said golf club shaft comprising in adjacent order from said tip end to said grip end a hosel section, a first intermediate section, a protruded section, a second intermediate section, and a grip section;

said first intermediate section having varying outer diameter increasing from its junction J1 with said hosel section to its junction J2 with said protruded section;

said second intermediate section having varying outer diameter increasing from its junction J3 with said protruded section to its junction J4 with said grip section;

said protruded section having varying outer diameter increasing from said junction J2 to an apex point between said junction J2 and said junction J3 and decreasing from said apex point to said junction J3;

the outer diameter of said shaft at said junction J3 being greater than that at said junction J2;

said junction J3 being located at a position spaced apart from said tip end a distance equal to 35–80% of the length from said tip end to said grip end; and the distance between said junction J2 and said junction J3 being in the range of 50–400 mm.

2. A golf club shaft as claimed in claim 1, wherein the outer diameter of said shaft at said apex point is greater by 0.3–3 mm than that at said junction J3.

3. A golf club shaft as claimed in claim 1, wherein the taper of said protruded section between said junction J2 and said apex point is in the range of 0.1–6.5% and the taper of said protruded section between said apex point and said junction J3 is in the range of 0.1–6.5%.

4. A golf club shaft as claimed in claim 1, wherein the distance between said junction J2 and said apex point is greater than that between said apex point and said junction J3.

5. A golf club shaft as claimed in claim 1, wherein the inside diameter of said shaft increases from a first point K1 located between said tip end and said junction J1 to a second point K2 located between said junction J1 and said junction J2 and from said second point K2 to a third point K3 located between said junction J4 and said grip end.

6. A golf club shaft as claimed in claim 5, wherein the taper of the outside surface of said shaft is as follows:

| | |
|---|---|
| between said junctions J1 and J2: | 0.1–1.5% |
| between said junction J2 and apex point: | 0.1–6.5% |
| between said apex point and junction J3: | 0.1–6.5% |

-continued

| | |
|---|---|
| between said junctions J3 and J4: | 0.1–1.5% |

while the taper of the inside surface of said shaft is as follows:

| | |
|---|---|
| between said tip end and first point K1: | 0–4% |
| between said points K1 and K2: | 0.2–4% |
| between said points K2 and K3: | 0.4–2% |
| between said point K3 and grip end: | 0–2%. |

7. A golf club shaft as claimed in claim 5, wherein the taper of the outside surface of said shaft is as follows:

| | |
|---|---|
| between said junctions J1 and J2: | 0.3–1% |
| between said junction J2 and apex point: | 0.5–4% |
| between said apex point and junction J3: | 1–5% |

-continued

| | |
|---|---|
| between said junctions J3 and J4: | 0.4–1% |

while the taper of the inside surface of said shaft is as follows:

| | |
|---|---|
| between said tip end and first point K1: | 0–3% |
| between said points K1 and K2: | 0.4–2% |
| between said points K2 and K3: | 0.5–1.5% |
| between said point K3 and grip end: | 0–1.5%. |

8. A golf club shaft as claimed in claim 1, wherein said junction J3 is located at a position spaced apart from said tip end a distance equal to 40–75% of the length from said tip end to said grip end, the length of said shaft is 850–1,200 mm, and wherein the distance between said junction J2 and said junction J3 is in the range of 80–350 mm.

* * * * *

UNITED STATES PATENT AND TRADEMARK OFFICE

CERTIFICATE OF CORRECTION

PATENT NO. : 5,551,691

DATED : September 3, 1996

INVENTOR(S) : HARADA et al

It is certified that error appears in the above-indentified patent and that said Letters Patent is hereby corrected as shown below:

Col. 4, line 22, "i" should read --1--;
line 23, after "2" insert --in Fig. 2--;
line 27, after "junction" insert --J3--; and
line 61, "F" should read --P--.

Signed and Sealed this

Fifteenth Day of April, 1997

*Attest:*

*Attesting Officer*

BRUCE LEHMAN

*Commissioner of Patents and Trademarks*